US005439784A

United States Patent [19]

Grimsey et al.

[11] Patent Number: 5,439,784

[45] Date of Patent: Aug. 8, 1995

[54] METHOD AND APPARATUS FOR PHOTOGRAPHIC PROCESSING SOLUTION REPLENISHMENT

[75] Inventors: Andrew D. Grimsey, Luton; David M. Henson, Wealdstone; Peter D. Marsden, Middlesex; Peter J. Twist, Bucks, all of Great Britain

[73] Assignee: Eastman Kodak Company, Rochester, N.Y.

[21] Appl. No.: 946,455

[22] PCT Filed: Apr. 16, 1991

[86] PCT No.: PCT/EP91/00735

§ 371 Date: Oct. 19, 1992

§ 102(e) Date: Oct. 19, 1992

[87] PCT Pub. No.: WO91/16666

PCT Pub. Date: Oct. 31, 1991

[30] Foreign Application Priority Data

Apr. 18, 1990 [GB] United Kingdom ..... 9008750

[51] Int. Cl.[6] ..... G03C 7/00; G03C 7/407; G03C 7/44

[52] U.S. Cl. ..... 430/399; 430/373; 430/414; 430/936; 430/943; 430/364; 430/367

[58] Field of Search ..... 430/364, 367, 373, 399, 430/936, 943, 414, 450, 477

[56] References Cited

U.S. PATENT DOCUMENTS

| | | | |
|---|---|---|---|
| 3,276,874 | 10/1966 | Levenson et al. | 96/66 |
| 3,765,891 | 10/1973 | Travis | 430/373 |
| 3,822,723 | 7/1974 | Crowell et al. | 137/624.15 |
| 4,062,684 | 12/1977 | Hara et al. | 430/373 |
| 4,081,280 | 3/1978 | Corluy et al. | 430/399 |
| 4,084,969 | 4/1978 | Nakamura et al. | 430/373 |
| 4,245,034 | 1/1981 | Libicky et al. | 430/399 |
| 4,346,981 | 8/1982 | Kaufmann | 354/324 |
| 4,348,475 | 9/1982 | Wernicke et al. | 430/399 |
| 4,977,067 | 12/1990 | Yoshikawa | 430/398 |

FOREIGN PATENT DOCUMENTS

| | | | |
|---|---|---|---|
| 2527398 | 1/1976 | Germany | 430/373 |
| 53-13416 | 2/1978 | Japan | 430/399 |
| 59-65846 | 4/1984 | Japan . | |
| 61-80150 | 4/1986 | Japan . | |
| 1268126 | 3/1972 | United Kingdom . | |
| 1399481 | 7/1975 | United Kingdom . | |
| 1403418 | 8/1975 | United Kingdom . | |
| 1560572 | 2/1980 | United Kingdom . | |
| 2059090 | 4/1981 | United Kingdom . | |
| 8604522 | 8/1986 | . | |
| 9013061 | 11/1990 | WIPO . | |
| 9112567 | 8/1991 | WIPO . | |

OTHER PUBLICATIONS

Patent Abstracts of Japan, vol. 10, No. 250 (p. 491)(2306) 28 Aug. 1986.

Patent Astracts of Japan, vol. 8, No. 171 (p-293)(1608) 8 Aug. 1984.

*Primary Examiner*—Charles L. Bowers, Jr.
*Assistant Examiner*—J. Pasterczyk
*Attorney, Agent, or Firm*—J. Lanny Tucker

[57] ABSTRACT

A method for replenishing an unstable photographic processing solution is disclosed, including the following replenisher solutions:

(1) a color developer replenisher,
(2) an oxidizing agent replenisher, and
(3) a halide-containing seasoning replenisher (starter solution).

The oxidizing agent is not removed from the developer-/amplifier after use.

5 Claims, 5 Drawing Sheets

METHOD AND APPARATUS FOR PHOTOGRAPHIC PROCESSING SOLUTION REPLENISHMENT

FIELD OF INVENTION

Figure 1:
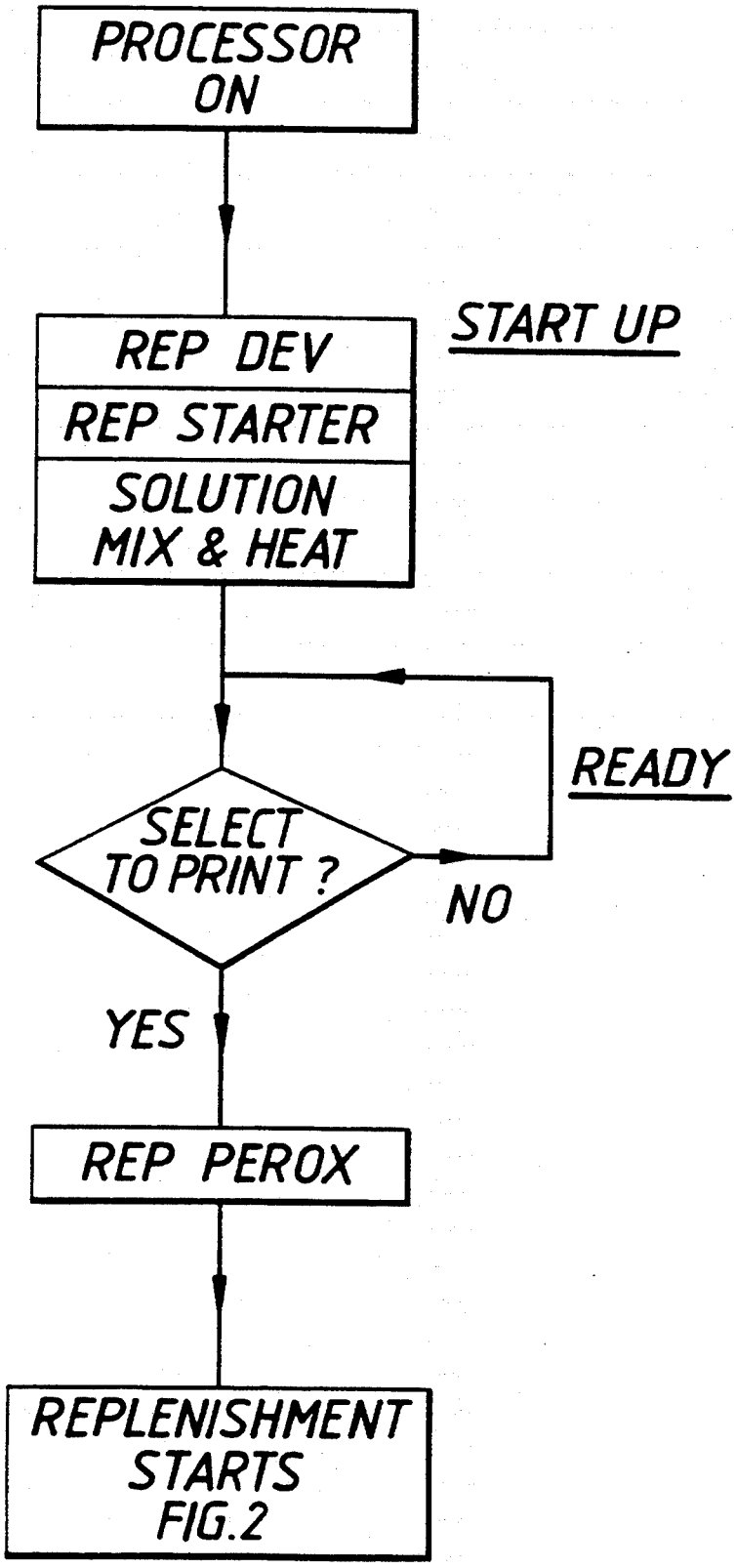

This invention relates to a method of replenishing photographic processing solutions and to apparatus useful therefor.

BACKGROUND OF THE INVENTION

Conventional colour photographic silver halide materials are processed by a process which includes a colour development step. When such processing is carried out in a machine it is normal practice to replenish at least the developer to replace components lost in use. Usually the colour developer replenisher is designed to take account of the seasoning effect of halide ions removed from the photographic material during development. This means that when the developer solution is first made up before any processing has taken place a starter solution is also used to introduce sufficient halide so that the initial developer contains the amount of halide ions found in the steady state fully seasoned developer solution.

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or developer-amplifier) to form a dye image. The redox amplifying solution contains a reducing agent, for example a colour developing agent, and an oxidising agent which will oxidise the colour developing agent in the presence of the silver image which acts as a catalyst. Oxidised colour developer reacts with a colour coupler (usually contained in the photographic material) to form image dye. The amount of dye formed depends on the time of treatment or the availability of colour coupler rather than the amount of silver in the image as is the case in conventional colour development processes. Examples of suitable oxidising agents include peroxy compounds including hydrogen peroxide, cobalt (III) complexes including cobalt hexammine complexes, and periodares. Mixtures of such compounds can also be used. A particular application of this technology is in the processing of silver chloride colour paper, especially such paper with low silver levels.

Since the amplifying solution contains both an oxidising agent and a reducing agent it is inherently unstable. That is to say, unlike a conventional colour developer solution, developer-amplifier solutions will deteriorate in less than a few hours, often in less than one hour, if left in a sealed container. It will, of course, deteriorate if left in a developing tank. One method of dealing with this problem is to use a discrete amount of processing solution for each unit of photographic material and discard it when the material has been processed. This is the so-called "one shot" approach which generally leads to the maximum chemical usage and effluent generation.

When such an unstable processing solution is used in a processing machine the usual replenishers used for conventional colour developers will not be applicable. In a standard replenishing mode the developer is only replenished while photographic material is actually being processed. This is inadequate for an unstable processing solution because, in addition to a small normal amount of aerial oxidation, the oxidising agent (eg $H_2O_2$) will oxidise most of the colour developing agent on standing.

PCT application WO 90/1306 published 1st Nov. 1990 (after the priority date of the present application) which describes a redox amplification system in which oxidant is removed from the developer/amplifier solution after use to increase its stability thus increasing its working life. It will be appreciated that the removal of peroxide from a developer/amplifier bath is a considerable additional task which is preferably to be avoided.

SUMMARY OF THE INVENTION AND DESCRIPTION OF PREFERRED EMBODIMENTS

According to the present invention there is provided a method of replenishing an unstable amplifying solution comprising a colour developing agent and an oxidising agent in which the following replenisher solutions are employed:

(1) a colour developer replenisher, (2) an oxidising agent replenisher and, (3) a halide-containing seasoning replenisher (starter solution), and in which process oxidising agent is not removed from the developer/amplifier after use.

During processing, replenishers (1) and (2) can be added on the basis of the area of photographic material processed or at regular time intervals.

When no processing is taking place (idling time), time-dependent replenishment (TDR) can be used to maintain amplifying solution consistency to allow processing to begin again immediately at any time. TDR would use the developer replenisher and oxidant replenisher solutions as with normal replenishment but would require, in addition, a developer starter solution. The developer starter is necessary to maintain a halide level equivalent to that produced during the processing of a silver halide paper which would otherwise be diluted by TDR.

Generally, in the area of machine processing, the solutions are circulated and the replenisher is added to the circulating solution and mixed therewith. This is the preferred way of operating the present invention.

In one embodiment of the present invention (1) all three replenisher solutions are added at a regular time interval while no processing is taking place (idling time).

In another embodiment of the present invention (2) all three replenisher solutions are only added prior to the restarting of processing after period of idling to re-establish consistency.

In another embodiment of the present invention (3) the developer replenisher solution is added at a regular time interval while idling while the other two are added only prior to the restarting of processing.

In yet another embodiment of the present invention (4) a combination of schemes (1), (2) and (3) are employed, dependant on machine utilisation and to reduce effluent and oxidation product build up.

Preferably the replenishment is controlled by a computer whose software is able to choose the most appropriate method of operating.

All the above options use less replenisher and produce less effluent that a batch solution ("One shot")

system with the same chemistry in every possible usage situation (except for no usage at all).

The present invention is particularly useful in the processing of photographic colour paper materials whose silver halide emulsions contain at least 80% silver chloride, preferably at least 90% and especially substantially pure silver chloride.

One of the advantages of embodiment (1) is that the processor is able to process paper immediately. There is no need to first replace tank solution as in the other embodiments. Further, this option ensures that when not processing the replenishment and recirculation will turn over a consistent proportion of the tank volume, thus maintaining the desired levels of developing agent, oxidising agent, antioxidant and seasoning products. This option would however produce the most effluent and would require option (2) or a tank remix after an overnight shut-down.

Option (2) is ideal for reconstitution of the amplifier solution after an overnight shut-down or for other long periods of inactivity. It would also use lower volumes of replenisher than option (1). However oxidation products could form more readily and build-up to produce stain after few reconstitutions, especially after long stagnant periods. There would be a need for a remixing of the chemical tank at regular intervals.

In option (3) the advantages are that the amplifier solution becomes increasingly stable, there is less build-up of oxidation products, and the amplifier is more easily reconstituted after long periods of inactivity. In addition lower volumes of replenisher are used than option (1) and less frequent overnight dumping would be necessary. However it might prove complicated to ascertain the exact composition of the amplifier solution at any one time.

The clear advantage of option (4) is that the most suitable option could be chosen at any particular moment and set into action. This is preferably operated under computer control.

In one such combined option, option (1) is combined with a tank dump and remixing overnight using a version of option (2) for start-up. During normal operation of the system, TDR would be applied with all three replenishers at regular intervals while processing is not taking place, in addition to the normal replenishment during processing. The system would be drained for overnight shutdown and refilled with fresh solution the next morning. This fresh solution would contain developer and seasoning replenishers but no oxidising agent replenisher would be added until necessary, thus avoiding having an unstable solution until processing began. Although this arrangement would produce more effluent than some other options, the balance of advantages versus disadvantages is favourable. The additional effluent would in fact be some 10–20 per cent more effluent during a normal day's operation than if a stable solution was being used and no TDR was necessary.

The volumes of replenisher required for TDR depend on the volume of the tank. Thus if the tank volume can be kept small, the amount of replenisher required will also be small. This is in contrast to conventional processing where TDR is feasible more or less regardless of tank volume due to the better stability of conventional processing solutions. Preferably the ratio of tank volume to the maximum area of photographic material accomodatable therein is less than 11 $dm^3/m^2$ and preferably less than 3 $dm^3/m^2$. Such a small volume tank is described in our copending British Patent Application No 9003282.2 filed on 14th Feb. 1990.

Replenishment during processing and during idling can, if desired, be run with a simple timer. During processing, volumes of the three solutions are added as measured by paper throughput. If this measuring is done with a timer then the application of replenishment during processing and idling will differ only in the time between activation of the replenishment pumps. Using a timer could also allow replenishment volumes to be changed in software rather than in hardware. The timer would allow the replenishment to be linked to the printer and increase or decrease replenishment with changes in print density. This would increase consistency in varying density situations for a very low volume tank system.

Figure 2:
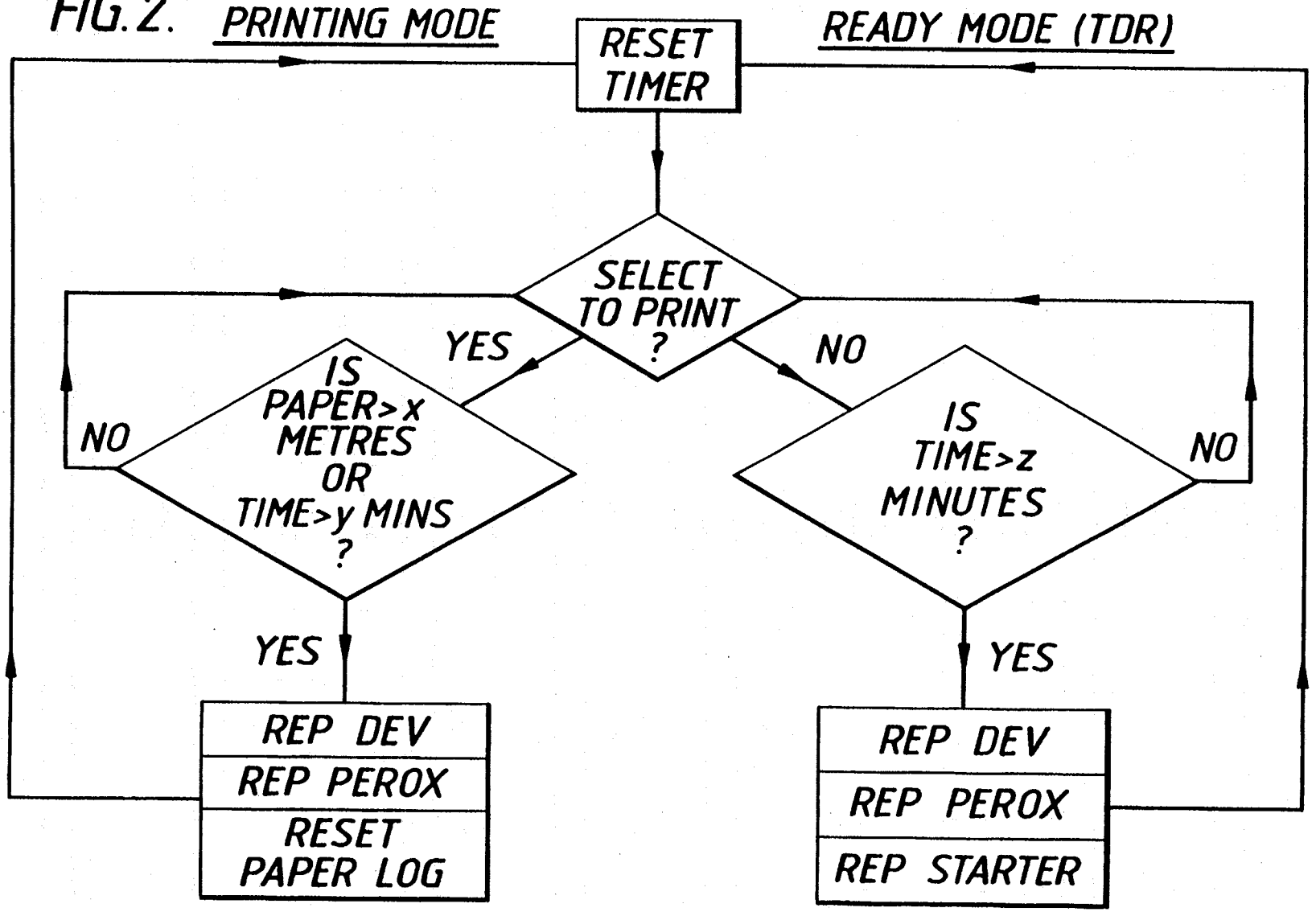

In the accompanying drawings, FIG. 1 is a flow chart for a start up procedure while FIG. 2 a flow chart for processing and idling.

In FIG. 1 the flow sheet shows how the developer and starter replenishers are added and mixed while the addition of the oxidising agent replenisher waits for processing (or printing in an associated printer) to begin. With reference to the figures, the following definitions shall apply: "REP" is "replenish", "DEV" is "developer", "PEROX" is "peroxide". "STARTER" is "start solution" (halide-containing seasoning replenisher). FIG. 2 shows the scheme for use during the day for both processing and non-processing periods.

The following Example is included for a better understanding of the invention.

EXAMPLE

In this example the developer-amplifier (dev-amp) solution had the composition:

DEVELOPER-AMPLIFIER

1-Hydroxyethylidene-1,1-diphosphonic acid (anti-calcium agent) 0.6 gm
Potassium Carbonate 10.0 gm
Diethylhydroxylamine (80%) 2.5 ml
Potassium chloride 0.3 gm
Potassium bromide 1.2 mg
4-N-ethyl-N(ö-methanesulphonamidoethyl)-o-toluidine sesquisulphate (colour developing agent CD3) 2.0 gm
Hydrogen Peroxide (30%) 4.5 ml
Water to 1.0 litre
pH=10

This composition is the working tank dev-amp and is maintained in this condition when paper is not being processed by means of time dependent replenishment with a replenisher of the following composition:

REPLENISHER (D-REP)

1-Hydroxyethylidene-1,1-diphosphonic acid (anti calcium agent) 0.6 gm
Potassium Carbonate 15.0 gm
Diethylhydroxylamine (80%) 4.5 ml
Potassium Chloride 0.3 gm
Potassium Bromide 1.2 mg
CD3 4.8 gm
pH=10.4

In this example chloride and bromide were included in D-PEP to simplify the experimentation but they would preferably be added via a separate solution when a substantially pure silver chloride paper was being processed.

In addition to D-REP, a peroxide replenisher (3% hydrogen peroxide solution in water) was also used.

A length of imagewise exposed photographic colour paper based on substantially pure silver chloride emulsions and containing a total of 144 mg/m$^2$ of silver was processed continually over a six hour period. The development time was 60 seconds at 32° C. Replenisher solutions were added as follows:

D-REP 53.3 ml/litre every 15 mins.

Peroxide replenisher 2.9 ml/litre every 15 mins.

and the replenishment was achieved by removal of 56 ml of developer-amplifier solution and replacement with the above volumes of the two replenishers. The solution removed was used to determine the concentrations of the colour developer and hydrogen peroxide in the amplifier solution by analysis. It is noted that in normal practice, replenishers are usually added into the system and the overflow discarded.

Figure 3:
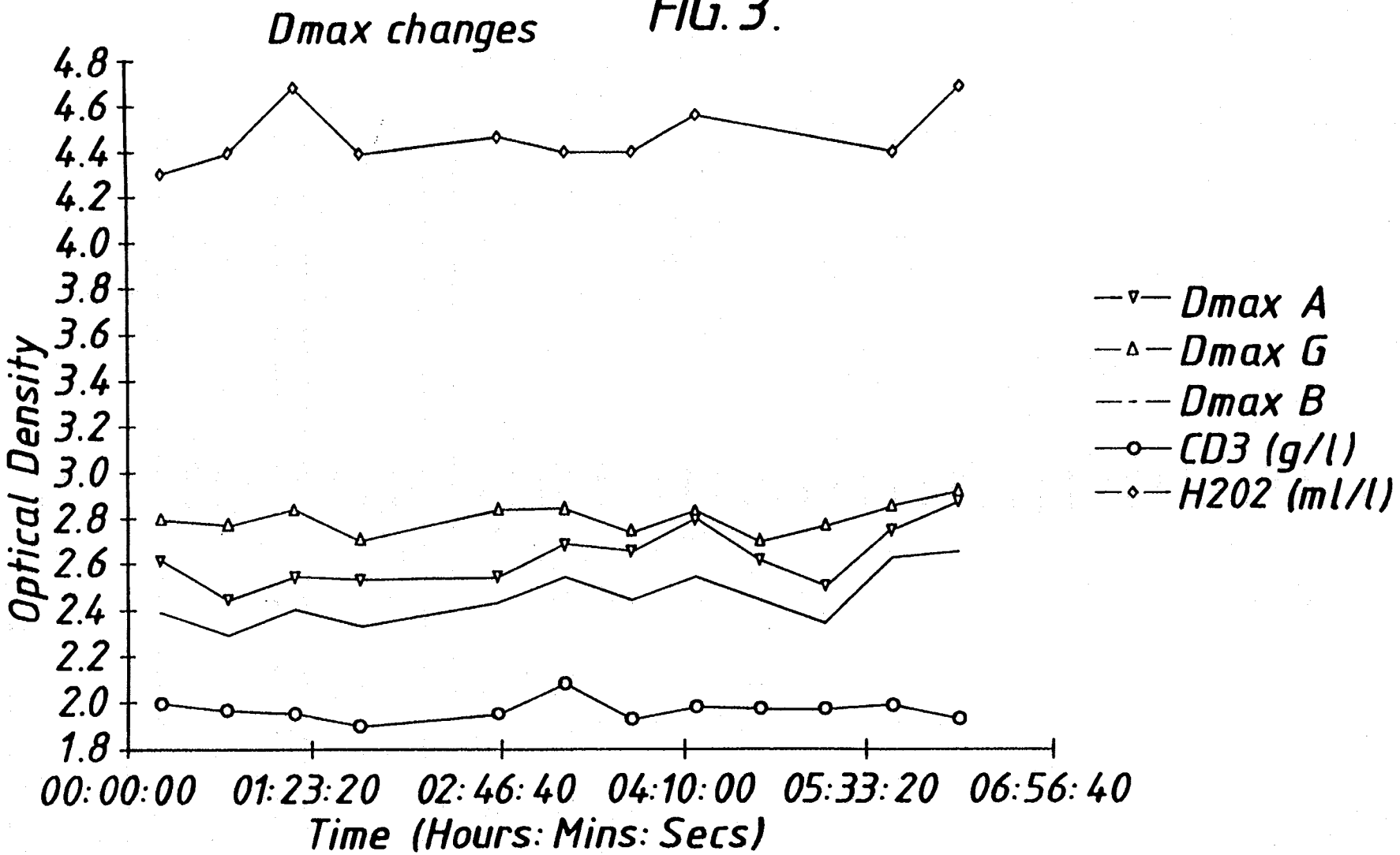
Figure 4:
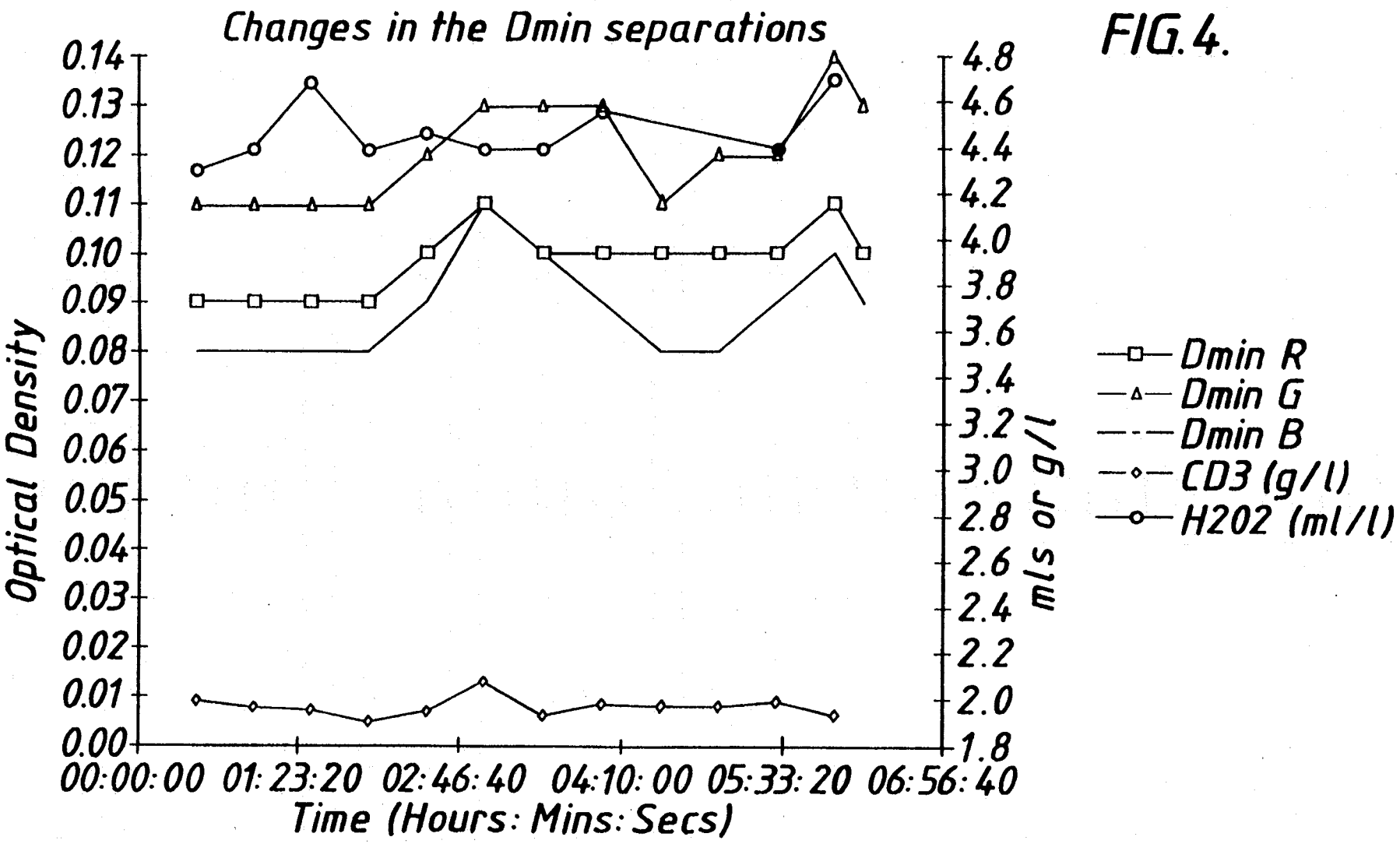
Figure 5:
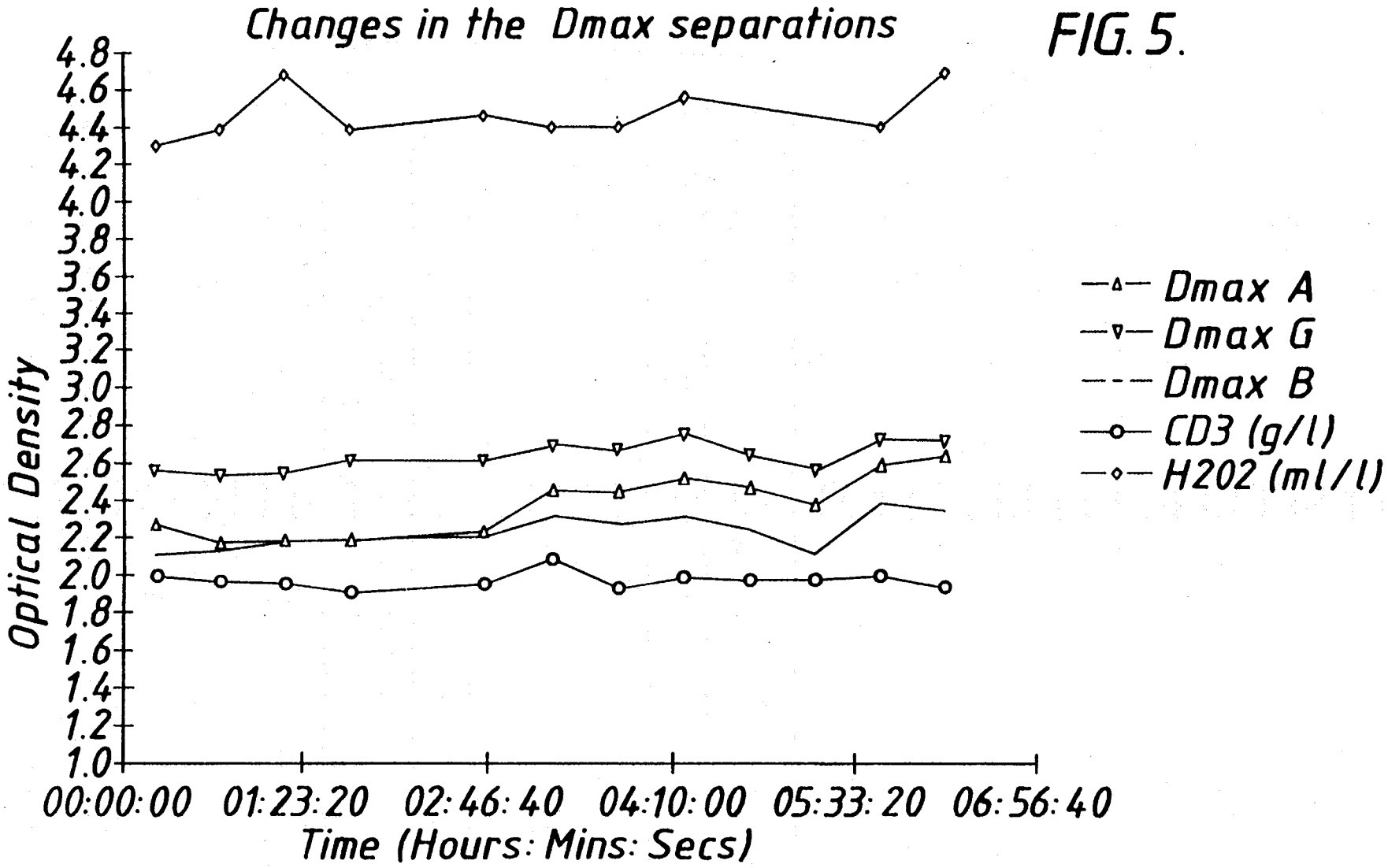

The results are shown in FIGS. 3–5 of the accompanying drawings in which FIG. 3 is a plot of Dmax (red, green and blue) and CD3 and hydrogen peroxide concentrations over a six hour period. FIGS. 4 and 5 are similarly the density plots of Dmin and Dmax separation densities.

We claim:

1. A method of processing color photographic silver halide material comprising the steps of:

contacting exposed color photographic silver halide material with a processing solution comprising a color developing agent and an oxidizing agent and replenishing said processing solution with replenisher solutions including a color developing agent replenisher, an oxidizing agent replenisher and a halide-containing seasoning replenisher (starter solution), wherein said replenishing is conducted without removing said oxidizing agent from said processing solution in which either said three solutions are added at a regular time interval while no processing is taking place (idling time), said three replenisher solutions are only added prior to restarting of processing after a period of idling, or color developing agent replenisher is added at a regular time interval while idling and the other two of the said three replenisher solutions are added only prior to restarting processing.

2. A method as claimed in claim in which the processing solution is held in a processing machine which comprises means for circulating said solution and in which the replenisher solutions are added to and mixed with the circulating processing solution.

3. A method as claimed in claim 1 in which all three replenisher solutions are added at a regular time interval while no processing is taking place (idling time).

4. A method as claimed in claim 1 in which the oxidising agent is hydrogen peroxide.

5. A method of processing as claimed in claim 1 in which the photographic material to be processed is a silver halide colour paper containing substantially pure silver chloride emulsions.

* * * * *

UNITED STATES PATENT AND TRADEMARK OFFICE

CERTIFICATE OF CORRECTION

PATENT NO. : 5,439,784

DATED : Aug. 8, 1995

INVENTOR(S) : Grimsey et al

It is certified that error appears in the above-indentified patent and that said Letters Patent is hereby corrected as shown below:

Col. 6, line 10, insert after "said three" --replenisher--.

Col. 6, line 19, insert after claim --1--.

Signed and Sealed this

Seventeenth Day of October, 1995

*Attest:*

Bruce Lehman

BRUCE LEHMAN

*Attesting Officer*

*Commissioner of Patents and Trademarks*